US011695203B2

(12) United States Patent
Hayles, Jr.

(10) Patent No.: US 11,695,203 B2
(45) Date of Patent: Jul. 4, 2023

(54) SYSTEM AND METHOD FOR MINIATURIZED CELL TOWER ANTENNA ARRAYS AND HIGHLY DIRECTIONAL ELECTRONIC COMMUNICATION

(71) Applicant: American Antenna Company, LLC, San Antonio, TX (US)

(72) Inventor: Ralph E. Hayles, Jr., San Antonio, TX (US)

(73) Assignee: American Antenna Company, LLC, San Antonio, TX (US)

( * ) Notice: Subject to any disclaimer, the term of this patent is extended or adjusted under 35 U.S.C. 154(b) by 0 days.

(21) Appl. No.: 17/055,408

(22) PCT Filed: May 20, 2019

(86) PCT No.: PCT/US2019/033095
§ 371 (c)(1),
(2) Date: Nov. 13, 2020

(87) PCT Pub. No.: WO2019/222735
PCT Pub. Date: Nov. 21, 2019

(65) Prior Publication Data

US 2021/0210850 A1 Jul. 8, 2021

Related U.S. Application Data

(60) Provisional application No. 62/673,682, filed on May 18, 2018.

(51) Int. Cl.
*H01Q 3/24* (2006.01)
*H01Q 1/24* (2006.01)
(Continued)

(52) U.S. Cl.
CPC ..... *H01Q 3/245* (2013.01); *H01Q 1/246* (2013.01); *H01Q 15/08* (2013.01); *H01Q 19/06* (2013.01);
(Continued)

(58) Field of Classification Search
CPC ..... H01Q 3/245; H01Q 1/246; H01Q 15/08; H01Q 19/06; H01Q 21/20; H01Q 25/007; H01Q 21/28
See application file for complete search history.

(56) References Cited

U.S. PATENT DOCUMENTS 5,821,908 A * 10/1998 Sreenivas ..... H01Q 19/062 343/753
10,056,698 B2 * 8/2018 Montgomery ..... H01Q 19/062
(Continued)

FOREIGN PATENT DOCUMENTS

DE 4430832 A1 11/1995
GB 1366259 A 9/1974
(Continued)

*Primary Examiner* — Andrea Lindgren Baltzell
*Assistant Examiner* — Yonchan J Kim

(57) ABSTRACT

A solution to the growing customer demand on cell tower signal capacity is needed. As such, a directional antenna for cellular communication, a communications system using the directional antenna, and a method of communicating using the directional antenna are provided herein. In one example, the directional antenna includes: (1) a Luneburg lens having a spherical shape, and (2) a curved substrate that conforms to the spherical shape of the Luneburg lens, the curved substrate having a feed network of signal conveyors affixed to a front side and a ground plane back side, wherein the signal conveyors are aligned with the Luneburg lens to communicate radio frequency signals within a sector.

17 Claims, 6 Drawing Sheets

(51) Int. Cl.

| | |
|---|---|
| ***H01Q 15/08*** | (2006.01) |
| ***H01Q 19/06*** | (2006.01) |
| ***H01Q 21/20*** | (2006.01) |
| ***H01Q 25/00*** | (2006.01) |
| ***H01Q 21/28*** | (2006.01) |

(52) U.S. Cl.
CPC ..... *H01Q 21/20* (2013.01); *H01Q 25/007* (2013.01); *H01Q 21/28* (2013.01)

(56) References Cited

U.S. PATENT DOCUMENTS

| | | | | |
|---|---|---|---|---|
| 2004/0263421 | A1 | 12/2004 | Schaffner et al. | |
| 2011/0215968 | A1* | 9/2011 | Le Comte | G01S 1/40 342/406 |
| 2012/0034952 | A1* | 2/2012 | Lo | H04L 27/2605 455/562.1 |
| 2014/0139370 | A1* | 5/2014 | Hamner | G01S 13/4463 342/175 |
| 2015/0200450 | A1* | 7/2015 | Hayles | H01Q 15/08 343/754 |
| 2017/0324171 | A1* | 11/2017 | Shehan | H01Q 5/30 |
| 2019/0027823 | A1* | 1/2019 | Matitsine | H01Q 3/14 |
| 2022/0059941 | A1* | 2/2022 | Timofeev | H01Q 21/0031 |

FOREIGN PATENT DOCUMENTS

| | | | |
|---|---|---|---|
| WO | 2017119223 | A1 | 7/2017 |
| WO | 2019222735 | A9 | 11/2019 |

* cited by examiner

-PRIOR ART-

SYSTEM AND METHOD FOR MINIATURIZED CELL TOWER ANTENNA ARRAYS AND HIGHLY DIRECTIONAL ELECTRONIC COMMUNICATION

CROSS-REFERENCE TO RELATED APPLICATION

This application is the National Stage of, and therefore claims the benefit of, International Application No. PCT/US2019/033095 filed on May 20, 2019, entitled "SYSTEM AND METHOD FOR MINIATURIZED CELL TOWER ANTENNA ARRAYS AND HIGHLY DIRECTIONAL ELECTRONIC COMMUNICATION," which claims priority to U.S. Provisional Application No. 62/673,682 filed on May 18, 2018, and was published in English under International Publication Number WO 2019/222735 on Nov. 21, 2019. The above application is commonly assigned with this National Stage application and is incorporated herein by reference in its entirety.

TECHNICAL FIELD

This disclosure is directed, in general, to wireless communication systems and, more specifically, to directional antennas including a Luneburg lens.

BACKGROUND

Cell phone towers, such as 4G/LTE cell phone towers, are installed throughout the world to provide a network for wireless communication. In the United States alone, there are currently over two hundred thousand 4G/LTE cell towers and over four million throughout the world. A single tower can possess two or more operators and multiple carriers, with each entity employing their own varying antenna arrays (including panel, sector, and other antennas) mounted on platforms that orient the antennas for sector coverage that can range between 90° to 120° sectors.

The current antenna arrays are generally unsightly since they are large and do not blend into the surroundings. Additionally, since they are located at a high elevation in community/urban areas, such as on top of electrical transmission structures, office buildings or stand-alone towers, the antennas are easily visible. To minimize visual impact, municipalities typically regulate site locations in addition to other aspects of cell tower operations. Many municipalities (e.g., in California and Arizona) even require cell towers to blend into the environment to become less noticeable. As such, cell towers are constructed to appear as pine trees, cacti, or other natural forms.

As the demand for wireless communication continues to expand, so does the need for the wireless communications infrastructure. Accordingly, new cell towers are being added and the capacity of existing cell towers is being increased. With future demand for significantly increased bandwidth, signal capacity of current base station antenna designs is insufficient for the growing customer demand. Thus, current solutions include installing more unsightly cell towers and antennas, such as 4G/LTE cell towers. Many municipalities, however, refuse to issue permits for additional sites, which can result in poor reception/transmission, customer frustration, and lost business opportunities. The disclosure provides a new solution to the growing customer demands on cell tower signal capacity.

SUMMARY

In one aspect the disclosure provides a directional antenna for cellular communications. In one embodiment, the directional antenna includes: (1) a Luneburg lens having a spherical shape, and (2) a curved substrate that conforms to the spherical shape of the Luneburg lens, the curved substrate having a feed network of signal conveyors affixed to a front side and a ground plane back side, wherein the signal conveyors are aligned with the Luneburg lens to communicate radio frequency signals within a sector.

In another aspect, the disclosure provides a communications system. In one embodiment, the communications system includes: (1) radio equipment, and (2) a directional antenna coupled to the radio equipment via communications circuitry. The directional antenna having (2A) a Luneburg lens having a spherical shape, and (2B) a curved substrate that conforms to the spherical shape of the Luneburg lens, the curved substrate having a feed network of signal conveyors affixed to a front side and a ground plane back side, wherein the signal conveyors are aligned with the Luneburg lens to communicate radio frequency signals within a sector.

In yet another aspect, the disclosure provides a method of communicating using a communications system having a directional antenna and radio equipment. In one embodiment, the method includes: (1) receiving data via radio frequency signals within a sector defined by a directional antenna, wherein the directional antenna includes a Luneburg lens having a spherical shape, and a curved substrate that conforms to the spherical shape of the Luneburg lens, the curved substrate having a feed network of signal conveyors affixed to a front side and a ground plane back side, wherein the signal conveyors are aligned with the Luneburg lens to communicate radio frequency signals within a sector, (2) providing the received data to the radio equipment, and (3) transmitting within the sector and employing the directional antenna, data received from the radio equipment.

BRIEF DESCRIPTION

Reference is now made to the following descriptions taken in conjunction with the accompanying drawings, in which.

DETAILED DESCRIPTION

The disclosure provides an improved directional antenna that can be employed on communications structures, such as cell towers. The directional antenna provides an increased communication capacity for both data and voice communications at multiple frequencies in a significantly smaller package than conventional antenna arrays. The resulting communications structures that employ the disclosed directional antenna provide a more visibly appealing option than traditional structures while providing more communications capacity. The directional antennas include miniaturized feed networks and a Luneburg lens to provide highly directional electronic communication antennas.

Figure 2:
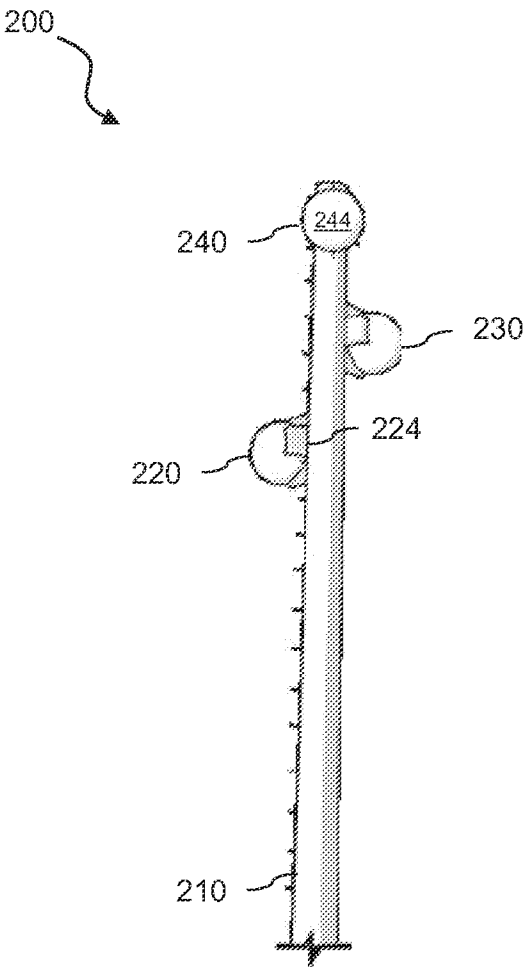
FIG. 2 illustrates a diagram of an example of a communications system having directional antennas constructed according to the principles of the disclosure.
Figure 1:
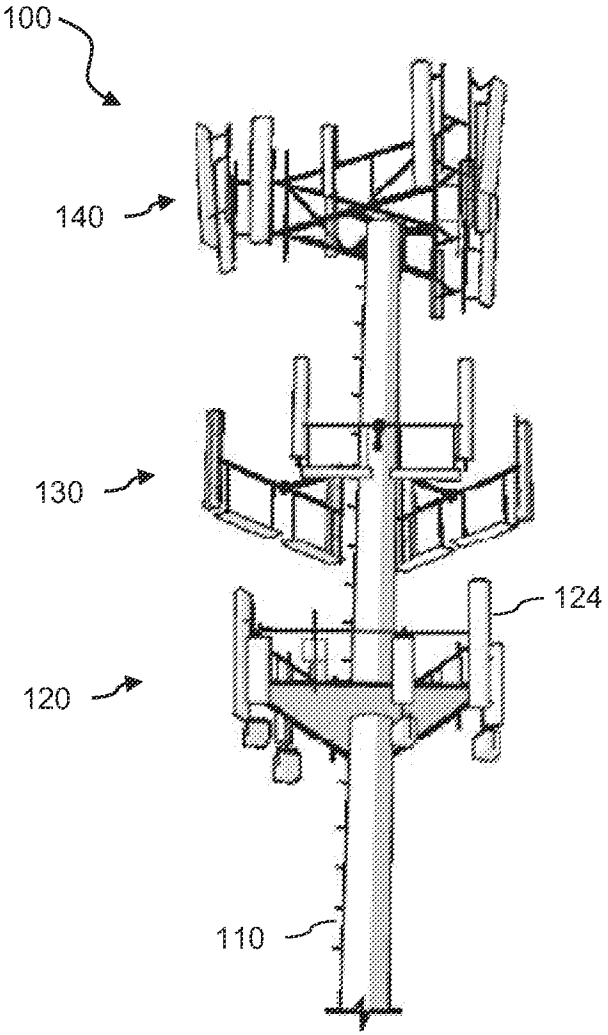
FIG. 1 illustrates a diagram of an example of a traditional cell tower.

The disclosed directional antenna possesses materially increased bandwidth (capacity) over current 4G/LTE antenna arrays. In addition, the directional antenna array is significantly smaller than current cell tower antenna arrays and reduces scenic clutter. FIGS. 1 and 2 show the significantly reduced antenna size due to the miniaturization disclosed herein. The disclosure provides an antenna that is smaller, less intrusive, more attractive, and has more customer capacity compared to antennas presently being used on 4G/LTE towers. For example, each directional antenna employing a 35" Luneburg lens is capable of hosting up to 72 or more current antennas and 3 or more carriers in each 120° sector, thereby significantly increasing bandwidth (capacity). Additionally, each 24" Luneburg lens version is capable of hosting up to 48 or more current antennas and two or more carriers in each 120 degree sector. Nevertheless, the features disclosed herein are not limited by Luneburg lens aperture sizes or radio frequencies. For example, 5"-12" Luneburg lenses configured with a 5G miniaturized feed network assembly can create a highly effective 5G network in the 3-13 GHz frequencies.

The directional antennas can be mounted on various supports or structures at various locations, including a tower, elevated structure (roof top, etc.), terrain elevation, aviation platforms, land vehicles, ships, and space platforms. The directional antennas are connected to radio equipment that then creates a communication network for public, private, commercial, space, and/or military use. As disclosed herein, the directional antennas can also be added to existing cell towers to increase carriers and customers being served while decreasing weight, volume, wind loading, and appearance concerns when compared to adding more existing antenna arrays. The resulting dramatic reduction of existing cell tower antenna arrays, supporting electronics, and platforms combine to require substantial reductions in annual tower climbs to inspect, repair, and replace equipment compared to existing cell tower antenna arrays. Even with a great reduction in scale compared to present day cell tower antenna arrays and associated platforms, communication systems employing the disclosed directional antennas can permit an increase of the number of: carriers; radio frequency signals; defined radio frequency signal regions; and customers being served. Additionally, the defined region or sector of the directional antennas can vary. The directional antenna can be mounted as a 3×120° or 4×90° or other sector systems on elevated structures to create 360° coverage.

The Luneburg lens base station antenna (BSA) is a passive beam-forming, highly directional, and high gain antenna that is in early stage usage in the cell tower marketplace. Luneburg lens antennas provide superior beam focusing resulting in multi-beam sector coverage with superior customer separation and frequency reuse. Current Luneburg lens BSA models are not providing sufficient improvement over existing BSA technology and have therefore been relegated to minor roles. The disclosure herein unlocks the unused capabilities of the Luneburg lens BSA by, for example, geospatial placement of signal conveyors that thereby significantly increase bandwidth (capacity) compared to current BSA technologies. Tower climbs can be substantially reduced from current BSA cell tower arrays.

Proper geospatial placement of signal conveyors onto a substrate material is employed to unlock the unused capabilities as each signal conveyor provides its own beam-forming communication sector. For example, the signal conveyors can be patch antennas that are circular in design and adhere to the formula of: Patch Antenna Diameter=0.25×Wave Length. In some example, proprietary patch antenna designs can reduce patch antenna diameter to 0.20×Wave Length. Carrier/customer frequency specifications can be used to determine actual patch antenna diameter. Additionally, individual patch antenna placement can be customized to fit elevation needs of the customers (example: mountainside communities, high rise buildings, etc.).

Continuing the example of patch antennas, tilting of the communications beams can be provided in different ways, including: 1) alignment of all patch antenna focused beams are down tilted during manufacturing so that the tops of the focused beams are parallel to the horizon; and 2) during installation on a cell tower (or other elevated structure), network engineers can specify further tilting requirements if needed. Installation procedures permit beams provided by the directional antenna to be easily tilted by moving the miniaturized feed network assembly slightly up or down in relation to the Luneburg lens.

Figure 7:
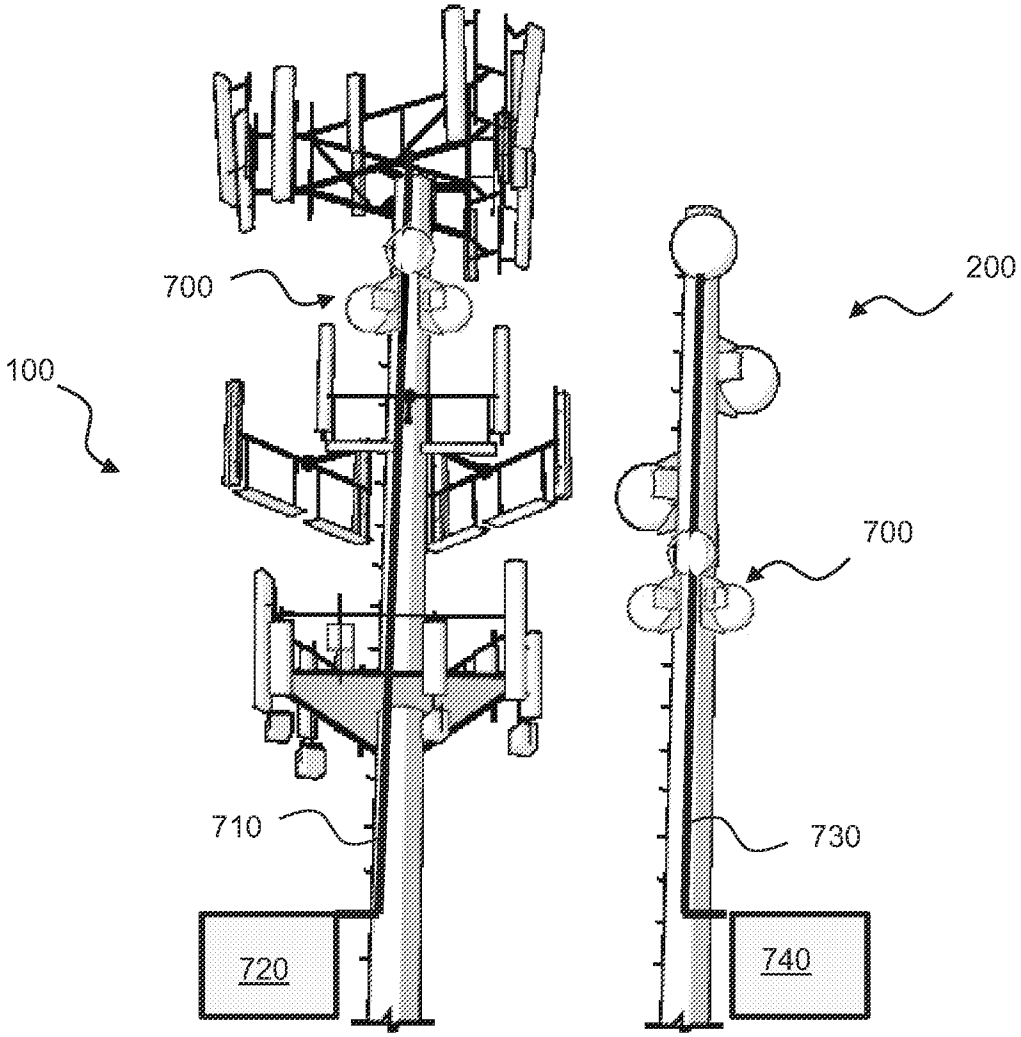
FIG. 7 illustrates a diagram that compares the cell tower of FIG. 1 to the communications system of FIG. 2 with both having an added 24" Luneburg lens directional antenna array.

FIG. 1 illustrates a diagram of an example of a traditional cell tower 100. The cell tower 100 includes a pole 110 and three different antenna arrays mounted on the pole 110. Each of the antenna arrays include multiple antennas that are configured to provide 360 degree coverage around the pole 110. A first antenna array 120 is for a first carrier, a second antenna array 130 is for a second carrier, and a third antenna array 140 is for a third carrier. The first, second, and third carriers can be, for example, Verizon, Sprint, and AT&T. As discussed above, the cell tower is unsightly. The cell tower 100 can include additional structures and components that are typically used with cell towers, such as radio equipment and tower cabling connecting the antenna arrays to the radio equipment as shown in FIG. 7.

FIG. 2 illustrates a diagram of an example of a communications system 200 having directional antennas constructed according to the principles of the disclosure. The communications system 200 also provides 360 degree coverage as the cell tower 100. Unlike the cell tower 100, however, communications system 200 employs less visually intrusive directional antennas. Additionally, instead of having an antenna array that provides 360 degree coverage for a single carrier, the communications system 200 includes multiple directional antennas that provide coverage within a defined sector of the 360 degrees for all of the carriers. Each of the directional antennas, therefore, can communicate radio frequency signals for multiple carriers within their sector. The communications system 200 can replace or complement all the radio frequency functions provided by the cell tower 100 employing the directional antennas disclosed herein; including communicating radio frequency signals can that bear voice and data. Additionally, each of the directional antennas can communicate radio frequency signals within their sector over multiple bands for each of the carriers, such as a high band and a low band. The high band can be between approximately 1700 to 2600 MHz and the low band can be between approximately 700 to 960 MHz. The communications system 200 includes a support 210, a first directional antenna 220, a second directional antenna 230, and a third directional antenna 240. The first directional antenna 220, the second directional antenna 230, and the third directional antenna 240, are collectively referred to as the directional antennas 220, 230, 240. The communications system 200 can also include tower cabling and radio equipment such as discussed above with respect to FIG. 1 and illustrated in FIG. 7.

The support 210 is constructed of a sufficient strength to support the directional antennas 220, 230, 240, and have a sufficient height to position the three directional antennas at an elevation for cellular communications. As such, the height of support 210 can vary depending on installation site. In FIG. 2, the support 210 is a pole but other supports, such as a lattice tower, a guyed tower, or mounts on structures such as a water tower or a rooftop, can be used. Additionally, a support can be attached to a vehicle for a mobile communications vehicle. In such examples, the support can be retractable so that the directional antennas can be raised and lowered. Due to the difference in size and also weight of the directional antennas 220, 230, 240, compared to the antenna arrays 120, 130, 140, the support 210 can be less robust than the pole 110. The directional antennas 220, 230, 240, can be attached to the support 210 via a mount employing bolts or another mechanical type of coupling. In some examples, a u-bolt mount can be used. A mount 224 for the first directional antenna 220 is denoted in FIG. 2 as an example.

The directional antennas 220, 230, 240, are arranged to provide 360 degree coverage with each one communicating radio frequency signals within a different sector. For example, each of the directional antennas 220, 230, 240, can be configured to provide 120 degree coverage and positioned on the support 210 to cover a different 120 degrees of the 360 degrees.

Each of the directional antennas 220, 230, 240, includes a Luneburg lens and a feed network of signal conveyors that are located within an outer cover that provides protection against the elements. Outer cover 244 of the third directional antenna 240 is denoted as an example in FIG. 2. The Luneburg lens of each of the directional antennas 220, 230, 240, has a diameter of 35 inches. Luneburg lenses of different diameter can be used in other communications structures. Regardless the diameter, the feed network is affixed (e.g., printed) to a substrate that is then curved and conforms to the spherical shape of the Luneburg lens. The angle of each sector of the directional antennas 220, 230, 240, corresponds to an arc length of the curved substrate that includes the feed network. In comparison to FIG. 1, each antenna of each of the antenna arrays 120, 130, 140, is a feed point of one of the feed networks of the directional antennas 220, 230, 240. Thus, each of the directional antennas 220, 230, 240, communicates radio frequency signals for multiple carriers within their sector. In some examples, a carrier or carriers may choose to have dedicated directional antennas for their use.

The feed network includes signal isolation features such that the carriers do not interfere with each other. Additionally, carriers enjoy the inherent isolation of feed points due to the physical beam-forming characteristics of the Luneburg lens. Advantageously, this assists in the co-location of multiple carriers on a single Luneburg lens. This provides a different architecture wherein multiple carriers are on a single antenna instead of each having its own platform and antennas as shown in FIG. 1.

The communications system 200 is smaller, less intrusive, is more attractive, and has more customer capacity compared to such cell towers as cell tower 100. Each 35" Luneburg Lens is capable of hosting up to 72 or more current antennas and 3 or more carriers in each 120° sector. This greatly increased data and voice transmit/receive capacity per cell tower will benefit the cellular industry. The disclosed features have the potential to reduce the number of cell towers a carrier is currently using. As noted above, Luneburg lenses of other sizes can also be used, such as a 24 inch diameter Luneburg lens. Each 24" diameter Luneburg Lens can host up to 48 or more current antennas and two or more carriers in each 120 degree sector. The disclosed directional antennas are not limited by Luneburg Lens aperture sizes or radio frequencies. Example, smaller diameter Luneburg Lenses configured with a 5G mid-band frequency miniaturized feed network can help create a highly effective 5G network, etc.

The directional antennas 220, 230, 240, advantageously use the geospatial placement of the signal conveyors that are optimized for maximum gain of each associated radio set that results in greater data and voice capacity when compared to existing Luneburg Lens antenna technologies. The Luneburg lens's passive beam-forming does not require electronic beam steering. Tower climbs will be substantially reduced, as any casual observer can assess from the FIG. 1 drawing, since there is much less hardware installed up on the communications system 200.

In one embodiment, the 35" Luneburg lens antenna replace up to 72 or more current sector antennas located in each 120° cell tower sector—a dramatic miniaturization of the existing cell tower antenna array landscape and reduction of scenic clutter. Each 35" Luneburg lens shown in FIG. 2 is replacing the 14 sector antennas shown in FIG. 1. In addition, using the 35 inch Luneburg lens as an example, the disclosed directional antennas can increase antenna feed points by as much as 400% over other 35" models in use today, and can equal the antenna feed points associated with 71" Luneburg lenses currently in use, thereby replacing the 495 pound 71" Luneburg lens with the much lighter 132 pound, 35" Luneburg lens while preserving customer capacity. The disclosed 55 pound, 24" Luneburg lens antenna can replace up to 48 or more current antennas located in each 120° cell tower sector—a dramatic miniaturization of the existing cell tower antenna array landscape. The 24" example is designed as an add-on sector antenna array (see FIG. 7) capable to permit additional carriers to join existing cell towers with minimal intrusion of tower space and the environment. The 24" directional antenna can also serve as a standalone antenna solution, accommodating two or more carriers. In some applications, the directional antenna, such as the 24" directional antenna, can be mounted on vehicles with telescoping towers to provide a substantial mobile cell tower capability for high density events, national disasters, and military uses.

Figure 3:
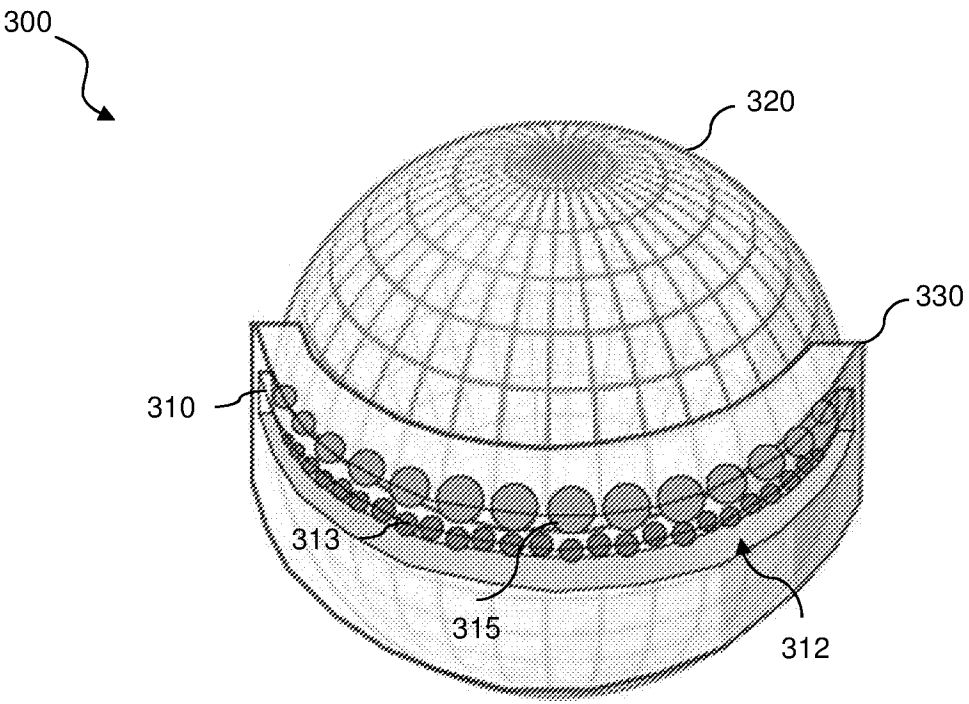
FIG. 3 illustrates a diagram of an example of a directional antenna constructed according to the principles of the disclosure.

FIG. 3 illustrates a diagram of an example of a directional antenna 300 constructed according to the principles of the disclosure. The directional antenna 300 includes a curved substrate 310, a Luneburg lens 320, and a protective shell 330. The directional antenna 300 can be employed in a communications structure, such as the directional antennas 220, 230, 240, of FIG. 2. The Luneburg lens 320 is 35" Luneburg lens.

Figure 4:
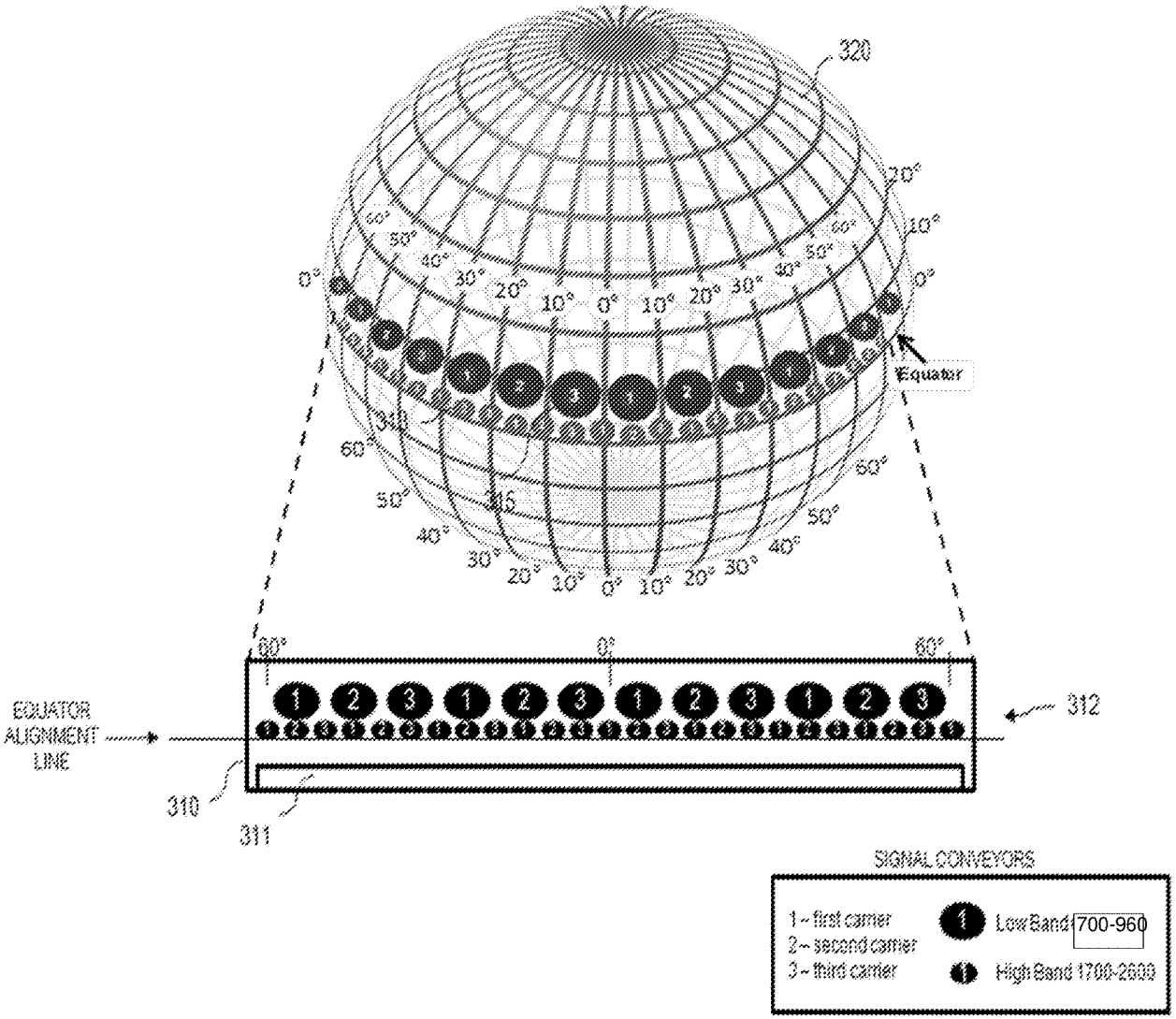
FIG. 4 illustrates a diagram of the feed network of FIG. 3 positioned with respect to the Luneburg lens of the directional antenna of FIG. 3.

The curved substrate 310 is shaped to conform to the spherical shape of the Luneburg lens 320. The curved substrate 310 has a feed network of signal conveyors 312 affixed to a front side and a back side that is a ground plane. The ground plane back side has been removed in this illustrated example for clarity. The signal conveyors 312 form a miniaturized feed network that can be printed on the curved substrate 310. The signal conveyors 312 are feed points that are aligned with the Luneburg lens to communicate (i.e., transmit and receive) radio frequency signals within a sector. In one example the signal conveyors 312 are patch antennas. The feed network of signal conveyors 312 provide multiple feed points for different frequency bands represented by different sized circles in FIG. 3. The signal conveyors 312 for a first band are represented by the smaller circles and the signal conveyors 312 for a second band are represented by the larger circles. A representative of the smaller circles and larger circles are denoted as signal conveyor 313 and signal conveyor 315. Though the size of the signal conveyors 312 change in FIG. 3 as they move away from the vertical zero degree axis, this simply represents the curvature of the curved substrate 310 as it wraps around the Luneburg lens 320. Each of the signal conveyors 312 for the first band are of substantially the same size (e.g., have the same diameter) and each of the signal conveyors 312 for the second band are of substantially the same size as illustrated in FIG. 4. The diameter of the signal conveyors 312 corresponds to the frequency of communication. For example, the first band can be a low band that is between approximately 700 to 960 MHz and the second band can be a high band that is approximately 1700 to 2600 MHz. As such, signal conveyor 315 has a larger diameter than signal conveyor 313. The curved substrate 310 includes a signal interface on the front side that is used as a connection point for the different signal conveyors 312. The signal interface is shown in FIG. 4.

The Luneburg lens 320 has a spherical shape in which the curved substrate 310 is conformed. As such, the curved substrate 310 can be positioned proximate the Luneburg lens 320 as illustrated. The curved substrate 310 is spaced, e.g., distally spaced, from the Luneburg lens 320 at a distance and location in order to provide optimum focusing of radio beams for communicating through the Luneburg lens 320. The distance, or gap width, can be determined by an operator of the directional antenna 300 and can be based on such factors as size of Luneburg lens, refractive properties of Luneburg lens, frequency of communication, etc.

The protective shell 330 covers the miniaturized feed network 312 on the curved substrate 310. The protective shell 330 can be curved or can include a curved portion that corresponds to the curved substrate, and can be made of a conventional material that protects the components without interfering with the communications. The curved substrate 310 with the miniaturized feed network 312 and the protective shell 330 can be referred to collectively as a curved assembly. FIG. 4 provides additional details of a feed network of signal conveyors 312.

FIG. 4 illustrates a diagram of the feed network 312 of FIG. 3 positioned with respect to the Luneburg lens 320. The feed network 312, or the feed points thereof, is spaced from and aligned with the 35" Luneburg lens 320 to provide an antenna that can host up to 72 or more antenna feeds and three or more carrier companies. The diameters of the signal conveyors of the feed network 312 e.g., patch antenna feed diameters, and positioning of the signal conveyors with respect to the Luneburg lens 320 can vary according to the frequencies being used, the requirements of the customer, and the elevations in the sectors being serviced. The numerals within each feed point correspond to a different carrier.

FIG. 4 illustrates an example of the curved substrate 310 before being conformed to the curvature of the Luneburg lens 320. A signal interface 311 is also shown as part of the curved substrate 310. The signal interface 310 provides connection points for the signal conveyors 312 for external connections, such as communications circuitry to the radio equipment. In this example, the signal conveyors 312 are patch antennas (patch antennas 312 for this example) that are circular in design and are printed on the curved substrate 310 before curving thereof. As such, the signal interface 311 can be printed circuitry that is connected to the patch antennas 312.

The diameter of the patch antennas 312 is a percentage of the wavelength used for communicating RF signals. In some examples, the diameters are twenty to twenty five percent of the communicating wavelengths. As noted above, carrier/customer frequency specifications can determine the actual diameters of the patch antennas 312. Additionally, the patch antennas 312 can be printed on the curved substrate according to alignment lines that are then used to align the curved substrate 310 with the Luneburg lens 320 to provide desired beam tilts. In FIG. 4, an alignment line that corresponds to the equator of the Luneburg lens 320 is used and the high band of the patch antennas 312 are printed along the equator alignment line. The curved substrate 310 can then be aligned with the equator of the Luneburg lens 320, employing the alignment line, to provide a built-in tilt. Other customized tilting can be provided when printing the patch antennas 312 on the curved substrate. For example, the patch antennas 312 can be printed such that the alignment line is between the low and high band patch antennas 312. Additionally, the spacing or gap between where the patch antennas are printed and the alignment line can vary. The spacing between each of the patch antennas 312 can also vary depending on carrier requests or installation designs. The alignment line also does not have to be used with the equator of the Luneburg lens 320. In other words, the alignment line can be used to align the curve substrate 310 at five (or another desired offset) degrees above the equator. In one example, 30° beams are down tilted in manufacturing 7.5°, and 15° beams are down tilted in manufacturing 3.75°, thereby creating parallel to the horizon beam tops. Accordingly, the signal conveyors can be positioned on the curved substrate 310 and aligned with the Luneburg lens 320 to provide a manufactured down tilt of beams for communicating the radio frequency signals within the sector. In addition to the tilting during manufacturing, the directional antenna 300 can also be tilted during installation. Radio signals can be transmitted and received inside the defined regions created by the patch antennas 312. The spacing and positioning of the patch antennas 312 feed points can be altered as required, for example, by changes in frequency, polarity, Luneburg lens diameter, technology innovation, and customer needs. The beams and coverage created by the patch antennas 312 feed points can also vary by hosting dual patch antenna feeds, tri patch antenna feeds, quad patch antenna feeds, and other innovations in signal conveyor technology feed points.

Figure 5:
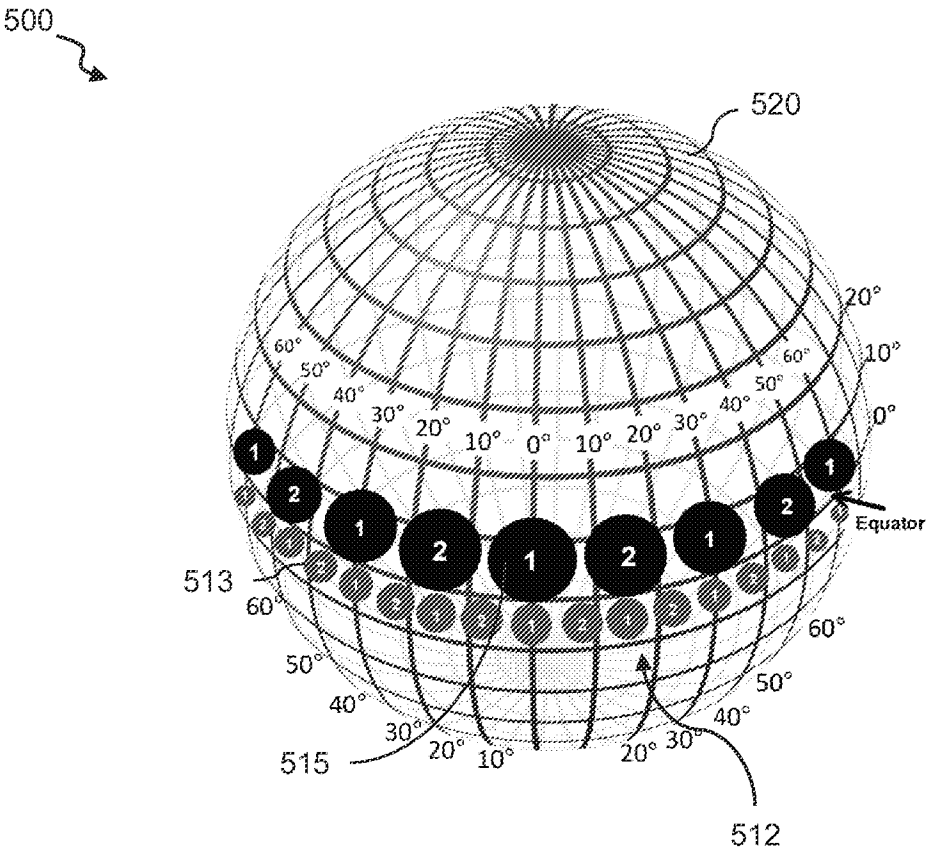
FIG. 5 illustrates a diagram of a portion of an example directional antenna constructed according to the principles of the disclosure.

FIG. 5 illustrates a diagram of a portion of an example directional antenna 500 constructed according to the principles of the disclosure. The directional antenna 500 includes a Luneburg lens 520 that has a diameter of 24 inches. As with FIG. 4, one skilled in the art will understand that the diameters of the feed points and positioning of the feed points with respect to the Luneburg lens 520 can vary according to such factors as the frequencies being used, the requirements of the customer, and the elevations in the sectors being serviced. Additionally, the numerals within each feed point correspond to a different carrier. The directional antenna 500 can host up to 48 or more antenna feeds from current cell tower antenna arrays and two or more carrier companies. The directional antenna 500 can also serve multiple bands. As with FIG. 4, some of the signal conveyors 512 are for a first band and some are for a second band. Those for a first band are represented by the light circles and those for the second band are represented by the dark circles. A representative one of the light circles and larger circles are denoted as signal conveyor 513 and signal conveyor 515. The first and second bands can be the high band and the low band of frequencies as denoted with respect to FIG. 4. The diameter of the signal conveyors 512 for each of the different bands are the same and the change in diameter size is used to illustrate placement of the signal conveyors 512 along the curvature of the Luneburg lens 520.

Figure 6:
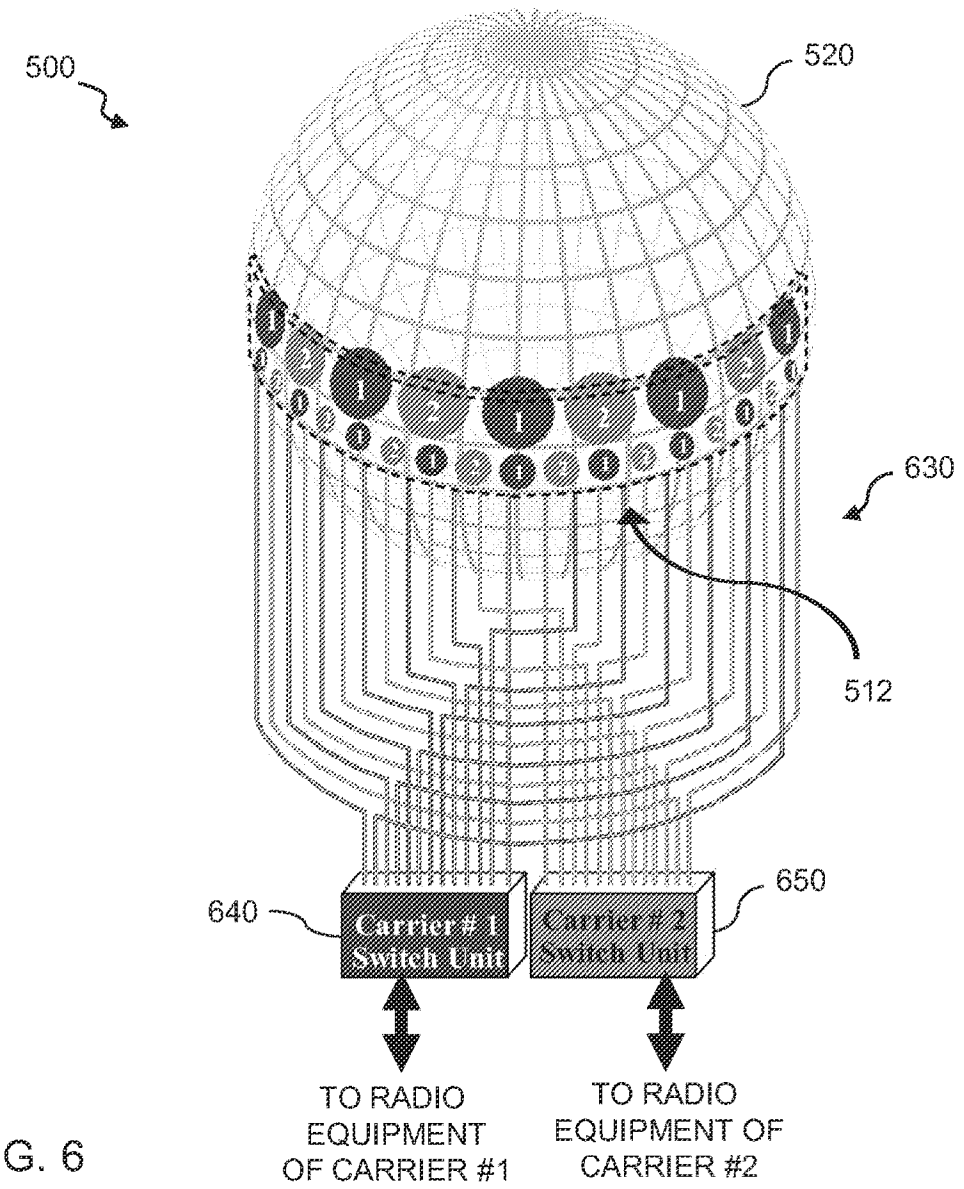
FIG. 6 illustrates a diagram that shows the directional antenna of FIG. 5 and wiring connecting the different signal conveyors of the feed network of the directional antenna to their respective radio equipment.

FIG. 6 illustrates a diagram that shows the directional antenna 500 and wiring, referred to as communications circuitry 630, connecting the different signal conveyors of the feed network 512 to their respective radio equipment. The communications circuitry 630 includes printed circuitry, wiring, connectors, and electronics necessary to convey radio frequency signals between (to/from) the signal conveyors of the feed network 512 to the corresponding radio equipment. More specifically, the geospatially placed, dual carrier, signal conveyors of the feed network 512 are coupled to their corresponding radio equipment via the communications circuitry 630 and carrier #1 or carrier #2 switching units, units 640 and 650. These switching units 640, 650, can provide multiple functions and preserve proprietary carrier electronic signals. The switching units 640, 650, can provide manual and remote switching that creates larger signal beams (combines two or more beams) when customer capacity requirements can be served with fewer radio sets, and restores smaller signal beams when needed. The switching units 640, 650, can also be used to add RF front end transmit power and connect the electronic radio signals to carrier radio sets located either close to the switching units 640, 650, or at another location, such as the base of the support. The carrier switching units 640, 650, can be altered as required due to changes in frequency, polarity, Luneburg lens diameter, technology innovation, number of carriers, and customer needs.

In one example, the carrier #1 and carrier #2 switching units 640, 650, can include a processor, data storage, circuitry, and other components that are configured to automatically connect signal conveyors together or disconnect signal conveyors to change a defined region of a sector or within a sector. The processor can be directed by an algorithm to make the changes based on customer demand within a sector. For example, some of the signal conveyors of the feed network 512 can be combined by wiring and connected to the same radio equipment to form larger defined regions of radio signal coverage if the larger defined region does not require, due to lower customer density, smaller defined region coverage. If the customer density increases, the wiring can be modified to activate smaller defined regions. Conversely, if customer density decreases, the wiring can be modified to activate larger defined regions. The switching units 640, 650, can also be used to manually change connections regarding the signal conveyors. For example, the switching units 640, 650, can include a terminal board wherein a technician can manually stack or otherwise combine signal conveyors thereby creating dual or multiple feed points from a single location.

FIG. 7 illustrates a diagram that compares the cell tower 100 to the communications system 200 with both having added a 24" Luneburg lens directional antenna array 700. FIG. 7 illustrates how efficiently more capacity can be added to existing cell towers, such as cell tower 100, and to communications system 200 that have directional antennas. Each of the 24" Luneburg lens directional antennas of the directional antenna array 700 can host up to 48 or more current antennas and two or more carriers in each 120 degree sector, a dramatic miniaturization and higher capacity of current antenna arrays.

Cell tower 100 includes tower cabling 710 and radio equipment 720. The tower cabling 710 and radio equipment 720 can be conventional components that communicate and process the radio frequency signals for the carriers. Communications system 200 also includes cabling 730 and radio equipment 740 that is connected to the directional antenna array 700 and the other antenna arrays via the cabling 730. The cabling 730 and the radio equipment 740 can provide additional communication capacity compared to the tower cabling 710 and the radio equipment 720 due to the additional transmit and receive capability of the communications system's 200 directional antennas. The cabling 730 can be part of the communications circuitry as discussed above with respect to FIG. 6. In one example the cabling includes coaxial cables.

Those skilled in the art to which this application relates will appreciate that other and further additions, deletions, substitutions and modifications may be made to the described embodiments.

The foregoing has outlined features so that those skilled in the pertinent art may better understand the detailed description. Those skilled in the pertinent art should appreciate that they can readily use the disclosed conception and specific embodiment as a basis for designing or modifying other structures for carrying out the same purposes of the disclosure. Those skilled in the pertinent art should also realize that such equivalent constructions do not depart from the spirit and scope of the invention. Those skilled in the pertinent art should appreciate that frequencies used by cell tower carriers often change with system upgrades and may require corresponding upgrades to base station antenna equipment to accommodate these changes. Such frequency upgrades and changes do not depart from the spirit and scope of the invention.

In one aspect, the disclosure provides an antenna for miniaturized, highly directional electronic communication. One embodiment provided herein includes: (1) a curved miniaturized feed network assembly (of multiple patch antennas) located proximate a portion of a Luneburg lens and configured with the Luneburg lens to transmit radio frequency signals within a defined region or receive radio frequency signals that originate within the defined region, with said miniaturized feed network being affixed to a curved substrate material with a ground plane backing that conforms to the Luneburg lens, (2) supporting electronics, power supply, and radio/wireless transceivers, (3) a protective shell/s, (4) a Luneburg lens located within a protective shell, and (5) a tower, elevated structure (roof top, etc.), terrain elevation, aviation and aerial platforms, vehicles, ships, and space platforms.

The Luneburg lens base station antenna (BSA) is a passive beam-forming, highly directional, and high gain antenna that is in early stage usage in the cell tower marketplace. Luneburg lens antennas provide superior beam focusing resulting in multi-beam sector coverage with superior customer separation and frequency reuse. Current Luneburg lens BSA models are not providing sufficient improvement over existing BSA technology and have therefore been relegated to minor roles. The unused capabilities of the Luneburg lens BSA is unlocked herein by, for example, geospatial placement of patch antennas that then create significantly more communications beams that provide more customer capacity compared to existing BSA technologies. The Luneburg lens's uses passive beam-forming (does not require electronic beam steering). Tower climbs will be substantially reduced, as any casual observer can assess from the FIG. 1 drawing—where there is much less hardware installed up on the cell tower.

In one example, a 35" Luneburg lens antenna disclosed herein can replace up to 72 or more current sector antennas located in each 120° cell tower sector—a dramatic miniaturization of the existing cell tower antenna array landscape. In the FIG. 1 drawing, each 35" Luneburg lens shown is replacing the 14 sector antennas shown. In addition, the 35" Luneburg lens antenna can increase antenna feed points by as much as 400% over other 35" models in use today, and can equal the antenna feed points associated with 71" Luneburg lenses currently in use, thereby replacing the 495 pound 71" Luneburg lens with the much lighter 132 pound, 35" Luneburg lens while preserving customer capacity. The 55 pound, 24" Luneburg lens antenna provided herein can replace up to 48 or more current antennas located in each 120° cell tower sector—a dramatic miniaturization of the existing cell tower antenna array landscape. The 24" Luneburg lens antenna is designed such that it can be used as an add-on sector antenna array (see FIG. 7) capable to permit additional carriers to join existing cell towers with minimal intrusion of tower space and the environment. The 24" Luneburg lens antenna can also serve as a standalone BSA solution, accommodating two or more carriers. In some applications, the directional antenna, such as the 24" directional antenna, can be mounted on vehicles with telescoping towers to provide a substantial mobile cell tower capability for high density events, national disasters, and military uses.

A portion of the above-described apparatus, systems or methods, such as some of the functions of the carrier switching units, may be embodied in or performed by various digital data processors or computers, wherein the computers are programmed or store executable programs of sequences of software instructions to perform one or more of the steps of the methods. The software instructions of such programs may represent algorithms and be encoded in machine-executable form on non-transitory digital data storage media, e.g., magnetic or optical disks, random-access memory (RAM), magnetic hard disks, flash memories, and/or read-only memory (ROM), to enable various types of digital data processors or computers to perform one, multiple or all of the steps of one or more of the above-described methods, or functions, systems or apparatuses described herein.

Portions of disclosed embodiments may relate to computer storage products with a non-transitory computer-readable medium that have program code thereon for performing various computer-implemented operations that embody a part of an apparatus, device or carry out the steps of a method set forth herein. Non-transitory used herein refers to all computer-readable media except for transitory, propagating signals. Examples of non-transitory computer-readable media include, but are not limited to: magnetic media such as hard disks, floppy disks, and magnetic tape; optical media such as CD-ROM disks; magneto-optical media such as floptical disks; and hardware devices that are specially configured to store and execute program code, such as ROM and RAM devices. Examples of program code include both machine code, such as produced by a compiler, and files containing higher level code that may be executed by the computer using an interpreter.

The summary section above includes aspects disclosed herein. Each of the aspects can have one or more of the following additional elements in combination:

Element 1: wherein the feed network of signal conveyors is a miniaturized feed network of patch antennas printed on the curved substrate. Element 2: wherein the feed network of signal conveyors is aligned with the Luneburg lens to exclude transmission of radio frequency signals to receivers outside the sector and exclude receiving radio frequency signals that originate outside of the sector. Element 3: further comprising a curved protective shell around the curved substrate. Element 4: wherein the signal conveyors are positioned on the curved substrate and aligned with the Luneburg lens to provide a manufactured down tilt of beams for communicating the radio frequency signals within the sector. Element 5: wherein the curved substrate further includes a signal interface connected to the feed network of signal conveyors. Element 6: wherein a diameter of the Luneburg lens is from two inches to seventy-two inches. Element 7: wherein the sector is from ninety degrees to three hundred and sixty degrees. Element 8: wherein the signal conveyors are aligned with the Luneburg lens to communicate radio frequency signals for different carriers within the sector. Element 9: wherein the communications circuitry includes at least one carrier switching unit coupled between the radio equipment and the directional antenna. Element 10: further comprising additional directional antennas, wherein a combination of the directional antennas provide 360 degree communication coverage for a communications structure. Element 11: wherein each of the directional antennas communicate radio frequencies for multiple carriers within a defined region. Element 12: wherein the Luneburg lens has a diameter of a first size and the communications system includes at least one more directional antenna that includes a Luneburg lens with a diameter of a second size that differs from the first size. Element 13: wherein the sector is from ninety degrees to three hundred and sixty degrees and a diameter of the Luneburg lens is from two inches to seventy-two inches.

What is claimed is:

1. A directional antenna for wireless communications within a single sector, comprising:

a Luneburg lens having a spherical shape and an equator; and a feed network of signal conveyors that are positioned in an arrangement conforming to a curved portion of the spherical shape and aligned with the Luneburg lens to communicate radio frequency signals within the single sector that is less than or equal to 120 degrees, wherein each of the signal conveyors are a same type of signal conveyor and are adjustably positioned with respect to the equator of the Luneburg lens, and the feed network of signal conveyors is aligned with the Luneburg lens to exclude transmission of the radio frequency signals to receivers outside of the single sector and exclude receiving the radio frequency signals that originate outside of the single sector.

2. The directional antenna as recited in claim 1 wherein the feed network of signal conveyors is a miniaturized feed network of patch antennas and each of the patch antennas are equally spaced apart in the arrangement along the curved portion.

3. The directional antenna as recited in claim 1 wherein the signal conveyors are positioned to communicate the radio frequency signals via communication beams, wherein a top of the communication beams are parallel to a horizon.

4. The directional antenna as recited in claim 2 wherein each of the patch antennas are affixed to a support structure for positioning in the arrangement and include an individual adjustment.

5. The directional antenna as recited in claim 2, wherein the patch antennas are non-steerable antennas when communicating the radio frequency signals.

6. The directional antenna as recited in claim 1 wherein a diameter of the Luneburg lens is from two inches to seventy-two inches.

7. The directional antenna as recited in claim 5, wherein the directional antenna includes a single feed network of signal conveyors.

8. The directional antenna as recited in claim 1 wherein the signal conveyors are aligned with the equator of the Luneburg lens to provide an up or down tilt of beams for communicating the radio frequency signals.

9. A communications system, comprising:

radio equipment; and a directional antenna coupled to the radio equipment via communications circuitry, wherein the directional antenna includes:

a Luneburg lens having a spherical shape; and a feed network of signal conveyors that are positioned along a curved portion of the spherical shape and aligned with the Luneburg lens to communicate radio frequency signals within a single sector that is less than or equal to 120 degrees, wherein each of the signal conveyors are positioned with respect to the equator of the Luneburg lens and the feed network of signal conveyors is aligned with the Luneburg lens to exclude transmission of the radio frequency signals to receivers outside the single sector and exclude receiving the radio frequency signals that originate outside of the single sector, wherein the Luneburg lens has a diameter of a first size and the communications system includes at least one more directional antenna that includes another Luneburg lens with a diameter of a second size that differs from the first size.

10. The communications system as recited in claim 9 wherein the communications circuitry includes at least one carrier switching unit coupled between the radio equipment and the directional antenna.

11. The communications system as recited in claim 9 further comprising additional directional antennas, wherein a combination of the additional directional antennas provide 360 degree communication coverage for a communications structure.

12. The communications system as recited in claim 9 wherein the signal conveyors are positioned in a linear arrangement along the curved portion of the spherical shape and each of the signal conveyors are a same type of signal conveyor.

13. The communications system as recited in claim 9 wherein the feed network of signal conveyors is a feed network of patch antennas that are dedicated to different carriers in the single sector.

14. The communications system as recited in claim 9 wherein the single sector is 120 degrees.

15. The communications system as recited in claim 9 further comprising a curved protective shell.

16. The communications system as recited in claim 9 wherein a diameter of the Luneburg lens is from two inches to seventy-two inches.

17. A method of communicating using a communications system having a directional antenna and radio equipment, comprising:

receiving voice or data via radio frequency signals within a sector defined by the directional antenna, wherein the directional antenna includes a Luneburg lens having a spherical shape, and a feed network of signal conveyors that are positioned along a curved portion of the spherical shape and aligned with the Luneburg lens to communicate radio frequency signals within a single sector that is 120 degrees or less, wherein each of the signal conveyors are adjustably positioned with respect to the equator of the Luneburg lens and the feed network of signal conveyors is aligned with the Luneburg lens to exclude transmission of the radio frequency signals to receivers outside the single sector and exclude receiving the radio frequency signals that originate outside of the single sector;

providing the received voice or data to the radio equipment; and transmitting within the single sector and employing the directional antenna, voice or data received from the radio equipment.

* * * * *